US006012407A

United States Patent [19]

Farley

[11] Patent Number: 6,012,407

[45] Date of Patent: Jan. 11, 2000

[54] TOWING APPARATUS

[76] Inventor: Patrick Daniel Farley, 2074 Stillwater St., White Bear Lake, Minn. 55110

[21] Appl. No.: 09/218,338

[22] Filed: Dec. 18, 1998

[51] Int. Cl.[7] ..... F16G 11/00

[52] U.S. Cl. ..... 114/215; 114/253

[58] Field of Search ..... 280/414.1, 483; 267/69, 136; 114/250, 253, 242, 215, 216

[56] References Cited

U.S. PATENT DOCUMENTS

| | | | |
|---|---|---|---|
| 682,536 | 9/1901 | Duncanson | 114/216 |
| 2,117,322 | 5/1938 | Hillman | 267/69 |
| 2,991,524 | 7/1961 | Dobrikin | 267/69 |
| 3,094,096 | 6/1963 | Florence | 114/253 |
| 3,353,817 | 11/1967 | Bollinger | 114/215 |
| 4,947,779 | 8/1990 | Grinde . | |

*Primary Examiner*—Stephen Avila
*Attorney, Agent, or Firm*—Walter K. Roloff; Robert A. Pajak

[57] ABSTRACT

A towing apparatus includes a generally tubular shaped elongated housing for enclosing an elastic cord secured to points on a towing cord. The towing cord is disposed, at least in part, within the elongated housing and is capable of extending, at least in part, through the opposing open ends. The elastic-type cord is secured at opposite ends thereof to spaced apart terminating points of the towing cord such that the length between the spaced apart points is greater than the length of the elastic cord. The elastic cord in the relaxed condition serves to bunch the towing cord segment between the space apart point within the elongated housing without entanglement. Connectors may be secured to each of the opposite ends of the towing cord for attachment of the towing apparatus to, respectively, a towing vessel and to a watercraft.

10 Claims, 3 Drawing Sheets

TOWING APPARATUS

FIELD OF THE INVENTION

The present invention relates generally to towing apparatuses, and specifically to a towing apparatus for towing a vehicle behind a larger towing vehicle, and more specifically to a towing apparatus for towing a relatively small auxiliary watercraft behind a stern of a larger towing vessel.

BACKGROUND OF THE INVENTION

Personal watercraft, commonly referred to by the acronym "PWCs", have become extremely popular among boating and water sports participants. However, PWCs have experienced some disfavor. Chief among complaints against PWCs is that these machines can be noisy, even when not operated in a high-powered or reckless manner. In various locales, restrictions have been imposed upon PWC operations that commonly include: speed limits; operating curfew times; and prohibiting operation of PWCs in a portion of, or even an entire expanse of, a body of water.

Another disadvantage to operation of PWCs results from practical considerations of a large group of users. That is, given their small size, PWCs are not capable of accommodating or transporting a large group of people throughout a body of water.

In response to these disadvantages, operators have attempted to tow their PWCs behind larger towing vessels, such as, for example, pontoon boats, by way of simple towropes. In this manner, a PWC may be operated in a water area where noise and operating concerns are not a factor, and so that the PWC may be available for use by various members of the flotilla.

For the most part, towing a PWC behind a towing vessel is difficult when using a towrope. A tow rope provides only a pulling action on the PWC; consequently, when the towing vessel slows its speed, the PWC will typically impact the towing boat's stern, possibly causing damage to both vessels.

Another disadvantage of using a towrope is that in operation, the towrope may become slack. In this situation, a portion of the towrope may then sink below the water's surface, to a depth where the rope portion may become entangled or fouled in the towing vessel's propeller or propulsion means.

A further problem associated with towropes pertains to difficulties in safely navigating both the towing vessel and the PWC. That is, a typical tow rope does not ensure longitudinal "tracking" of the PWC behind the towing vessel; when using a tow rope, a PWC may "drift" considerably from side-to-side behind the towing vessel.

Attempts have been made to alleviate these aforementioned towing problems. For example, U.S. Pat. No. 4,947,779 entitled "Watercraft Tow Bar" issued to Grinde provides a tow bar assembly for a PWC and towing vessel. Grinde teaches the use of a tow bar constructed by way of a generally longitudinally incompressible, but vertically flexible, bar member. However, tow bars, such as that of the aforementioned Grinde patent, require complicated mounting hardware and tend to be heavy and cumbersome in assembly and in operation.

Thus, there exists a need for a towing apparatus which effectively couples two vessels together for towing purposes in a manner which (i) provides a minimum separation distance between the vessels to aid in preventing their collision; (ii) cannot be entangled in the propeller or other components of the towing vessel; and (iii) permits good navigability or "tracking" of the vessels.

SUMMARY OF THE INVENTION

An object of the present invention is to provide a towing apparatus for towing one vessel or vehicle behind another vessel or vehicle.

An object of the present invention is to provide a towing apparatus for towing a relatively small vehicle behind a larger towing vehicle.

Another object of the present invention is to provide a towing apparatus for towing a relatively small auxiliary watercraft, such as a PWC, behind a larger towing vessel, such as a pontoon boat.

Yet another object of the present invention to provide a towing apparatus that aids in preventing collision between the towing vessel and a watercraft in tow, when the towing vessel slows in forward speed.

It is a further object of the present invention to provide a towing apparatus that limits the possibility of becoming fouled in a propeller of a towing vessel.

It is yet a further object of the present invention to provide a towing apparatus that may serve, alternatively, as a watercraft mooring device.

It is a still further object of the present invention to provide a towing apparatus that is self-contained, and does not require use of hardware mounted to either the towing vessel or to the watercraft.

It is another object of the present invention to provide a towing apparatus that maintains mutual stability of the towing vessel and the watercraft.

In accordance with the present invention, a towing apparatus includes a generally tubular shaped elongated housing having opposing open ends. A towing cord is disposed, at least in part, within the elongated housing, and extends, at least in part, through the opposing open ends of the housing. An elastic-type cord is secured, at opposite ends thereof, to spaced apart terminating points on the towing cord. In this construction, the length of the towing cord when taut, between the spaced apart terminating points, is greater than the length of the elastic cord; and the elastic cord is retained, at least in part, within the elongated housing. Connectors may be secured to each of the opposite ends of the towing cord for attachment of the towing apparatus to, respectively, tie points on a towing vessel and a watercraft.

DETAILED DESCRIPTION OF THE INVENTION

Figure 1:
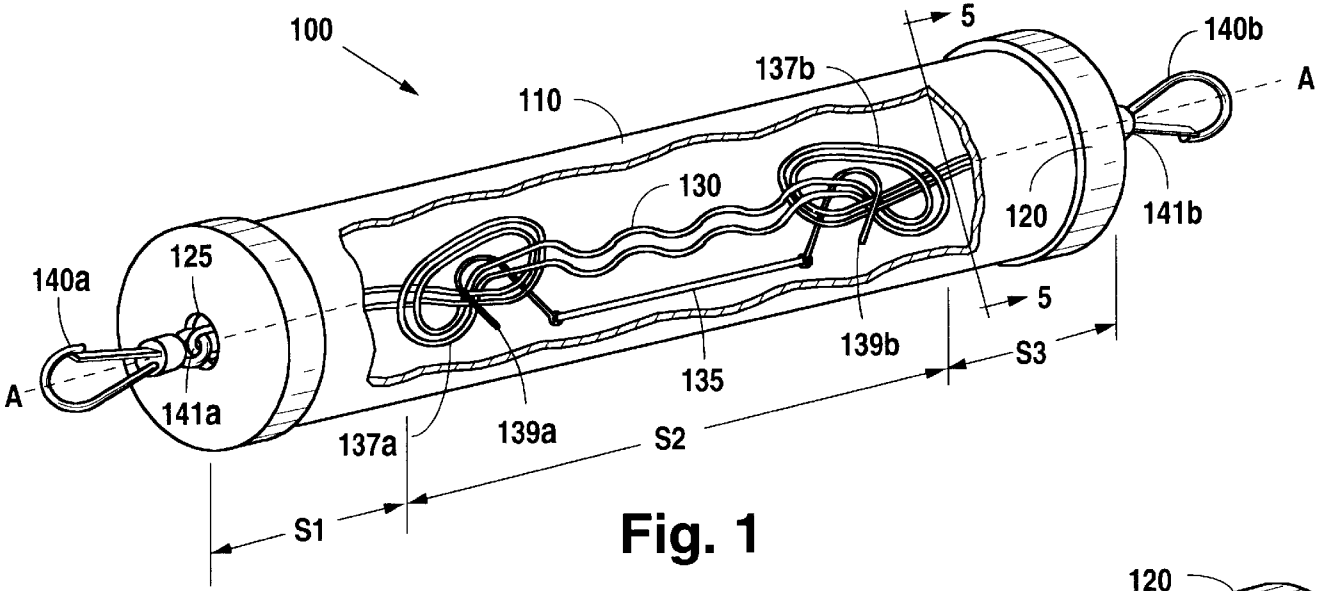
FIG. 1 is a perspective and cut-away illustration of a towing apparatus, constructed in accordance with the present invention, and depicting a relaxed towing cord condition.
Figure 2:
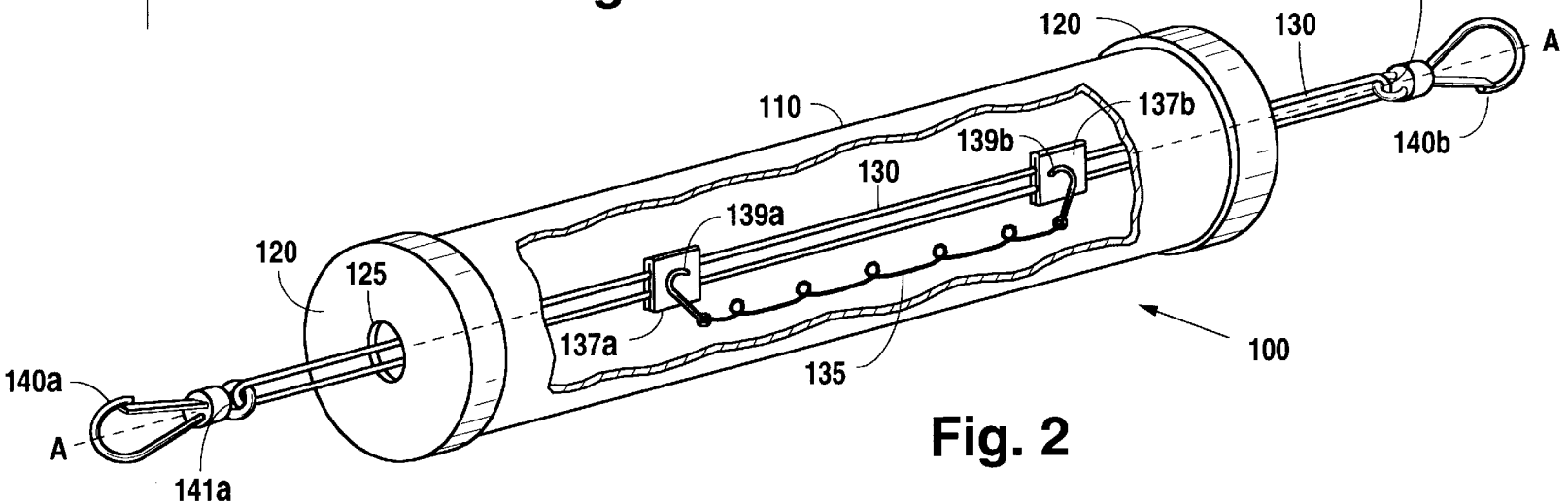
FIG. 2 is a perspective and cut-away illustration of a towing apparatus constructed in accordance with the present invention, and depicting a taut towing cord condition.

FIGS. 1 and 2 are perspective and cut-away illustrations of the present invention, in relaxed and taut towing cord conditions, respectively, as will be further described. The relaxed towing cord condition may be characterized as that of a natural state of the invention, not being subject to external towing forces. The taut towing cord condition may be characterized as that of maximum pulling forces being exerted in operation of the invention.

Referring now to FIG. 1, a towing apparatus 100 is illustrated in cut-away fashion, so that inner details may be readily ascertained, as will also be described. Towing apparatus 100 includes an elongated housing 110 having open ends, opposite end caps 120, towing cord 130 having knots 137*a* and 137*b*, elastic cord 135 having attached end hooks 139*a* and 139*b*, and clips 140*a* and 140*b*.

Elongated housing 110 is preferably tubular and may be, by way of an example, a cylindrically shaped pipe or tube. However, a rectangular tube, or the like, may also be used for elongated housing 110. For illustrative purposes, elongated housing 110 is illustrated as being disposed along a central reference axis A—A. In one embodiment of the invention, housing 110 is constructed from a plastic, for example, polyvinyl chloride plastic commonly referred to as "PVC." PVC or "PVC Pipe" is well known in plumbing applications, and typically PVC pipes or tubes are commercially available. An example of housing 110 is a commercially available PVC pipe or tube, having open opposite ends, an inside diameter of 1+½ inches, an outside diameter of 1+⅞ inches, and a length along axis A—A of 10 feet.

Towing cord 130, as illustrated in FIGS. 1 and 2, is a lengthwise loop of cord passing through housing 110, and having opposite loop ends generally indicated by numerals 141*a* and 141*b*. The lengthwise loop of towing cord 130 further includes two spaced apart knots, 137*a* and 137*b*, tied into towing cord 130 which define spaced apart "terminating points" on towing cord 130. These terminating points are spaced away from loop ends 141*a* and 141*b*, respectively. Further, knots 137*a* and 137*b* are illustrated as being generally within the enclosure provided by housing 110.

In accordance with the present invention, each end of elastic-type cord 135 is intended to be secured to a respective one of the terminating points on the towing cord 130. As illustrated in FIG. 1, elastic-type cord 135 includes hooks or clips 139*a* and 139*b* fastened at opposite ends of elastic cord 135. Hooks 139*a* and 139*b* are illustrated in FIGS. 1 and 2 as being secured to or "hooked into" knots 137*a* and 137*b*, respectively.

As used herein "terminating points" on the towing cord 130 refers to the general spatial position along the length of the towing cord, and provides a means for describing the invention. However, it is at these terminating points that each end of elastic cord 135 is intended to be secured to the towing cord 130. In the case of those terminating points being the same as the location of the knots, it should be recognized that the locations are somewhat loosely defined. However, in the practice of the present invention it is desired that when the towing cord is pulled from ends thereof, and the towing cord segment between their terminating points is taut, the elastic cord is not fully extended, i.e., not completely taut or stretched to its limits. In this scenario, when no forces are applied to the towing cord, the elastic cord will function as if it were a spliced segment of the overall towing cord as will be further described.

In should be further understood, that in the preferred embodiment of the invention, elastic cord 135 is secured to the towing cord along a central portion thereof. However, it should be recognized, that elastic cord 135 will function in the same intended manner if one end thereof is secured to one point being the same as one terminating end of cord 130, for example, end 141*a*, and the other end of elastic cord 135 is secured to a point on towing cord 130 at an appropriate distance away from end 141*a*, but which is greater than the distance equivalent to the length of elastic cord 135.

Towing cord 130, by way of example, may be a marine-grade 12 gauge nylon rope having a breaking strength of 3,000 pounds and a diameter of ½ inch. The tensile strength may be selected from a wide range of values depending upon needs of the user, with regard to a heaviness or difficulty of a particular towing application. In accordance with one embodiment of the invention, towing cord 130 is initially about 21 feet in length. Towing cord 130 is then connected end-to-end, or "doubled" to form the aforementioned lengthwise loop having a resulting length of about 10 feet, five inches, with loop ends 141*a* and 141*b* thus formed in towing cord 130. Further, in this example, knots 137*a* and 137*b* are tied into towing cord 130 at terminating points thereof located generally about 3 feet, 2+½ inches inward from each loop end 141*a* and 141*b*, respectively, of the "doubled" towing cord 130. In this manner, towing cord 130, so doubled, is tied to itself in two locations along its length, namely, at knots 137*a* and 137*b*.

Knots 137*a* and 137*b*, placed at the selected "terminating points" or locations on towing cord 130, results in towing cord 130 having, in appearance and function, three sections or lengthwise segments S1, S2, and S3 as indicated in FIG. 1. Specifically, towing cord 130 has a first such section S1 of about 3 feet, 2 inches in length, with knot 137*a* taking up about ½ inch of the 10 feet 5 inch length of towing cord 130. Following the first section is a second or intermediate section S2 of about 4 feet in length, between knots 137*a* and 137*b*. In turn, following the second or intermediate section of towing cord 130, is a third section S3 similar to the first section. This third section S3 of towing cord 130 is also a length of about 3 feet, 2 inches, with knot 137*b* taking up about another ½ inch of the 10 feet 5 inch length of towing cord 130.

Attached to towing cord 130 at knots 137*a* and 137*b*, are attachment hooks 139*a* and 139*b*, respectively, of elastic cord 135. The knots 137*a* and 137*b* serve as attachment points on towing cord 130 for the terminating ends of elastic cord 135, namely, attachment hooks 139*a* and 139*b*. In accordance with the present invention, the lengthwise distance between the attachment or terminating points on towing cord 130 when taut must be greater than the length of the elastic cord. For the exemplary embodiment of the invention, elastic cord 135 is a 3½ foot length of industrial strength heavy duty "bungee cord" having a diameter of about ½ inch to ⅝ inch, a relaxed length of about 3½ feet, and an elasticity greater than towing cord 130.

In accordance with the present invention, with the length of the elastic cord 135 being less than the separation distance between the attachment points on the towing cord 130 when taut, namely, at knots 137*a* and 137*b*, elastic cord 135 serves to draw or "bunch" together the aforementioned intermediate length section S2 when towing apparatus 100 is at rest, i.e., when towing cord 130 is in a relaxed condition. Towing cord 130, including the attached elastic cord 135, is intended to be contained, for the most part, within housing 110 as already indicated.

Opposite end caps 120 each have a diameter allowing them to be securely affixed to opposite ends of housing 110, as will be described below. Each end cap 120 includes a central aperture 125 in central alignment with reference axis A—A. Apertures 125 may be formed by drilling in any suitable manner so as to have a central aperture diameter sufficient to freely accommodate towing cord 130 passing therethrough. In the exemplary embodiment, end caps 120 are constructed from PVC and are also commercially available.

Figure 5:
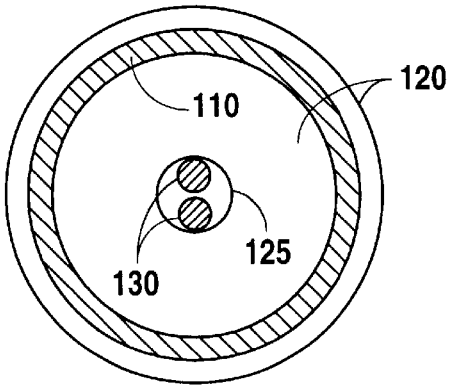
FIG. 5 is a cross-sectional illustration of the towing apparatus of FIG. 1, along cross-section reference line 5—5.

As illustrated in FIGS. 1 and 2, opposite loop ends 141*a* and 141*b* of towing cord 130 are disposed through apertures 125 of opposite end caps 120, such that, when end caps 120 are bonded to housing 110, towing cord 130 is disposed throughout housing 110 and generally along reference axis A—A. End caps 120 are affixed to the opposite ends of housing 110, in any suitable manner by way of bonding or threading. In the exemplary embodiment, commercially available PVC primer and glue are applied to inside surfaces of each end cap 120 such that, when the end caps 120 are placed on the ends of housing 110, the end caps 120 are substantially permanently bonded to housing 110. The relationship of end cap 120, cord 130, and tubular housing is particularly illustrated in the cross-section view of FIG. 5.

To complete the assembly of towing apparatus 100, clips 140*a* and 140*b* are attached to each end 141*a* and 141*b* of towing cord 130, respectively, outside of end caps 120 and apertures 125. Clips 140*a* and 140*b* are intended to provide an attachment means for attaching the towing apparatus 100 to tie points located on a towing vessel and on a watercraft. Clips 140*a* and 140*b* may be, for example, marine utility snap hooks, or the like, that are well known in the art.

The invention thus described is particularly suited for towing a PWC behind a pontoon boat. FIG. 2 illustrates one aspect of operation of the present invention. Specifically, in employment of towing apparatus 100 as shown in FIG. 2, clip 140*a* is attached to a tie point on a waterborne pontoon boat (not shown). Clip 140*b* is, in like manner, attached to a tie point on a waterborne PWC (also not shown).

Referring more particularly to FIG. 2, when the pontoon boat begins to move forward, in towing the PWC, opposing pulling and dragging forces are applied to towing cord 130 generally along axis A—A through clips 140*a* and 140*b*. These opposing forces tend to be transmitted to elastic cord 135 through knots 137*a* and 137*b*, and through hooks 139*a* and 139*b* that connect elastic cord 135 to towing cord 130, as aforedescribed. Before the opposing forces act on elastic cord 135, the intermediate length section S2 of towing cord 130 is "bunched up," and is in an "un-taut" or relaxed condition. Intermediate section S2 will remain relaxed until opposing forces act to stretch elastic cord 135 to a length substantially equal to the effective length of intermediate section S2 of cord 130. At this point, most of the opposing forces are transferred to the intermediate section S2, thereby causing towing cord 130 to eventually become fully taut along its entire length, as is specifically illustrated in FIG. 2. It should noted that elastic cord 135 may or may not be fully extended depending upon, of course, the length of elastic cord 135 in relation the effective length of intermediate section S2 of cord 130.

As towing cord 130 becomes taut in this manner, the pulling force of the pontoon boat at least equals or exceeds the drag force of the PWC, and the PWC is then towed through the water. It should be appreciated that as elastic cord 135 transitions from a relaxed condition to a more stretched condition, towing cord 130 lengthens along axis A—A, to a maximum length upon becoming taut itself.

Figure 3:
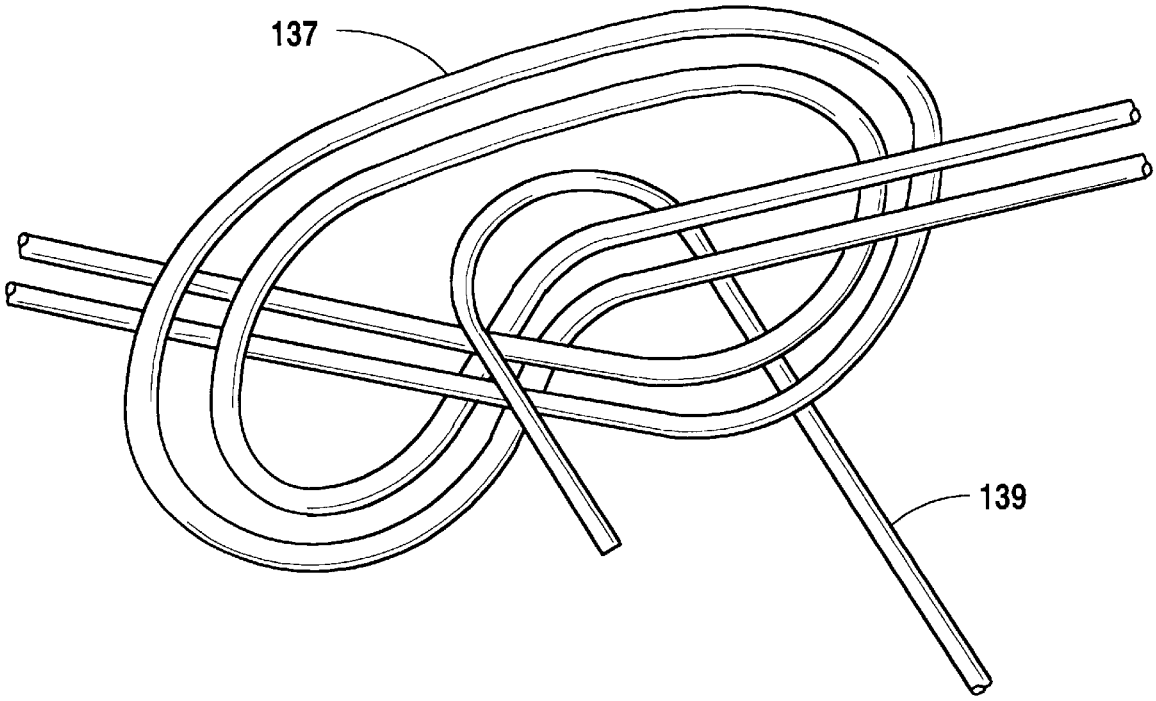
FIG. 3 is a magnified illustration of certain components of FIGS. 1 and 2.

Referring, now, to FIG. 3, a detailed blow-up or magnified view of a knot 137 as shown in FIGS. 1 and 2 is depicted. FIG. 3 is provided to clarify, in the preferred embodiment, the relationship between knot 137 in elastic cord 135, and hook 139. In this view, knot 137 has not yet been pulled tight in construction of towing apparatus 100, for ease and clarity of depiction therein. Of course, there are a wide array of knots which may serve the intended function of providing a loop for receiving the hook ends of elastic-type cord 135 for securing an end of elastic-type cord 135 thereto.

Figure 4:
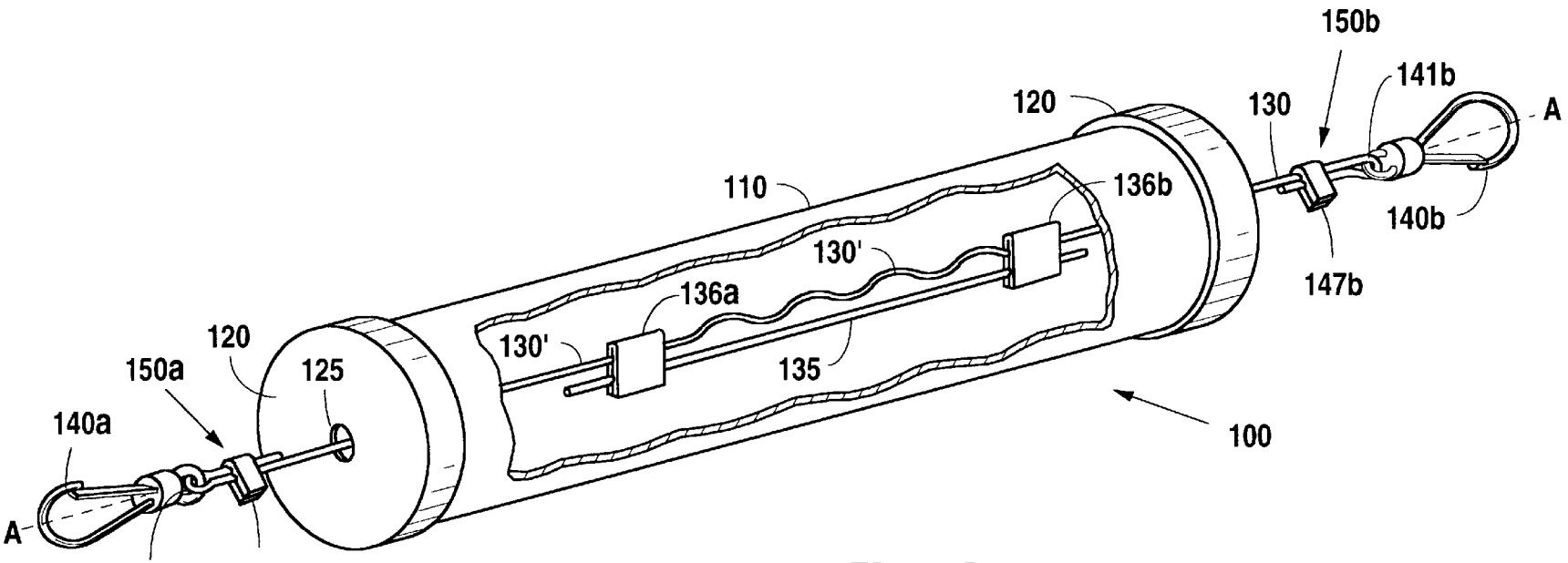
FIG. 4 is a perspective and cut-away illustration of a towing apparatus of another embodiment of the present invention, and depicting a taut towing cord condition.

In FIG. 4, an alternative embodiment of the present invention is illustrated. Therein, a "non-doubled" or "non-lengthwise looped" single towing cord 130' is substituted for the aforedescribed "doubled" towing cord 130 of FIGS. 1 and 2. Further, elastic cord 135 may be attached or secured to the selected attachment or terminating points on towing cord 130 by crimping means 136*a* and 136*b* or securely attaching ends of the elastic-type cord 135 to cord 130. In this arrangement, the aforedescribed knots 137*a* and 137*b* of FIGS. 1, 2, and 3 are eliminated, and no longer are hooks at the ends of elastic cord 135 required. Further, the loops at the ends of cord 130 may be formed by additional use of crimping means 147*a* and 147*b*, or mechanical clips, by folding back the ends of the towing cord and attaching each folded back portion directly to an end portion of the cord as generally indicated by numerals 150*a* and 150*b*. The crimping process is of course applied after clips 140*a* and 140*b* have been threaded with the end of towing cord 130.

The embodiment illustrated in FIG. 4 is just one alternative arrangement for securing an elastic-type cord 135 to a towing cord 130 in accordance with the present invention. There are, of course, a wide array of techniques for securing one cord to another, as well clips, and the kind of clips themselves. As used herein, crimping means 136*a* and 136*b*, as well as 147*a* and 147*b*, may be any mechanical structure which securely attaches two cord together, namely, one end of elastic cord 135 to a cord section of towing cord 130, thereby defining the terminating points on towing cord 130. As before, the length of the towing cord when taut between the terminating points is greater than the elastic-type cord, as aforedescribed.

Although not shown herein, it is of course possible to provide the intended attachment of the cords by various means including "hot melting" of the cords together, as well as bonding cements and the like, all of which are intended to be with the true spirit and scope of the present invention as claimed herein.

It will be appreciated that in operation, towing apparatus 100 prevents collision between a towed PWC and its towing vessel. That is, elongated housing 110 of towing apparatus 100 is intended to be substantially rigid and longitudinally incompressible so as to prevent the PWC from impacting the towing vessel's stern when the vessel slows in forward speed.

It will be further appreciated that elastic cord 135 acts to dampen oscillations of a watercraft being towed, in response to wave or wake action thereupon. Additionally, towing cord 130 and elastic cord 135, in combination, act together in response to wave conditions, or to a change in forward speed of the towing vessel, by expanding and contracting generally along axis A—A. It will be still further appreciated that in operation as aforedescribed, a watercraft "tracks" behind the towing vessel's wake due to inherent watercraft hull design properties.

The invention as thus described herein, in both assembly and in operation, has broad applications. That is, towing apparatus 100 may be used for towing not only waterborne craft, but also other vehicles such as automobiles and the like.

It should be appreciated by those skilled in the art that towing apparatus 100 may be employed as a dockside watercraft mooring device. Specifically, one clip 140 may be fastened to a cleat or other receiving member on a dock, while the other clip 140 is attachable to a tie point on a watercraft. In this manner, towing apparatus 100 may serve as a mooring device, and may thereby provide a coupling apparatus for coupling a watercraft to a fixed anchoring means, or the like, e.g., a dock.

While the present invention has been particularly shown and described with reference to the accompanying figures, it will be understood, however, that other modifications thereto are of course possible, all of which are intended to be within the true spirit and scope of the present invention.

More specifically, knots 137 may be replaced by crimping means 136, as aforesaid, including, and not not limited to, various bonding techniques for securing the elastic cord 135 to points on towing cord 130 in a manner as aforesaid. Also, clips 140 may be, as alternatives to the aforesaid marine utility snap hooks, any variety of suitable simple snap hooks.

Further, elastic cord 135 may be, as an alternative to the aforesaid exemplary embodiment, a helical wire spring, rubber cord or band, or the like—any of which may provide an elastic lengthwise cord. Also, end caps 120 may be omitted from towing apparatus 100. Towing cord 130 may be constructed from a wide array of materials including, but not limited to nylon, hemp, cotton, and the like, all of which are commercially available. It may be of course a single strand of material, or comprised of a bundle of strands.

In should be further understood, that in the preferred embodiment of the invention, elastic cord 135 is secured to the towing cord along a central portion thereof. However, it should be recognized, that elastic cord 135 will function in the same intended manner if one end thereof is secured to one point being the same as one terminating end of cord 130, for example, end 141 a, and the other end of elastic cord 135 secured to a point on cord towing 130 an appropriate distance away from end 141 a, but which is greater than the distance equivalent to the length of elastic cord 135.

Lastly, it should be recognized that towing cord 130 may a singular cord, or loop as already illustrated. Further towing cord 130 may also be a series of cords of differing material, including bungee cords of differing elasticity but more or less tensile strength than the elastic-type cord 135. However, preferably, elastic-type cord 135 should be coupled in parallel with a lengthwise portion of towing cord 130 which not elastic.

It should be recognized that the construction steps of the invention as described herein may be accomplished in a different order, from that described above. Accordingly, these and other various changes or modifications in form and detail of the present invention may also be made therein, again without departing from the true spirit and scope of the invention as defined by the appended claims.

What is claimed is:

1. A towing apparatus for towing a first vehicle behind a second vehicle, wherein said first vehicle and said second vehicle each include at least one tie point, said towing apparatus comprising:

an elongated tubular like housing member having opposing open first and second ends;

a towing cord having first and second terminating ends, said towing cord being disposed, at least in part, within said housing and being capable of passing, at least in part, through said opposing open ends of said housing;

an elastic-type cord of a selected length having a first terminating end secured to said towing cord at a first terminating point of said towing cord, and an opposite second terminating end secured to said towing cord at a second terminating point of said towing cord, such that said first and second terminating points are separated by a length greater than said selected length of said elastic cord; and means for retaining said elastic cord, at least in part, within said housing.

2. The towing apparatus of claim 1 further comprising:

a first connector means coupled to said first terminating end of said towing cord, adapted for connection to said tie point of said first vehicle; and;

a second connector means coupled to said second terminating end of said towing cord, adapted for connection to said tie point of said second vehicle.

3. The towing apparatus of claim 1, wherein said housing member is substantially a rigid tubular member.

4. The towing apparatus of claim 1, wherein said housing member is constructed from a plastic material.

5. The towing apparatus of claim 1, wherein said housing member is constructed from PVC like material.

6. The towing apparatus of claim 1, wherein said towing cord includes at least one non-elastic cord length-segment coupled in parallel and lengthwise to said elastic-type cord.

7. The towing apparatus of claim 1, wherein said elastic-type cord material comprises rubber-like material.

8. The towing apparatus of claim 1, wherein towing cord is a nylon rope.

9. The towing apparatus of claim 1, further comprising first and second end cap members secured to said first and second open ends, respectively, with each of said end cap members having an aperture and wherein at least portions of said towing cord are capable of freely passing through each aperture of said end cap members.

10. A towing apparatus for towing a first vehicle behind a second vehicle, wherein said first vehicle and said second vehicle each include at least one tie point, said towing apparatus comprising:

an elongated housing having opposing open first and second ends;

a towing cord having first and second opposite end sections, and an intermediate section located between said opposite end sections, said towing cord being disposed, at least in part, within said housing and being capable of passing, at least in part, through said opposing open ends of said housing;

an elastic-type cord of a selected length having a first terminating end secured to said intermediate section of said towing cord at a first terminating point of said towing cord, and an opposite second terminating end secured to said intermediate section of said towing cord at a second terminating point of said towing cord, such that said first and second terminating points are separated by a length greater than said selected length of said elastic cord;

a first connector means coupled to said first end section of said towing cord, adapted for connection to said tie point of said first vehicle; and;

a second connector means coupled to said second end section of said towing cord, adapted for connection to said tie point of said second vehicle.

* * * * *